United States Patent [19]

Poon

[11] Patent Number: 4,928,796

[45] Date of Patent: May 29, 1990

[54] LIFT

[76] Inventor: Otto L. Poon, 17th Floor, Java Centre, 124-134 Java Road, North Point, Hong Kong

[21] Appl. No.: 207,179

[22] Filed: Jun. 15, 1988

[30] Foreign Application Priority Data

Nov. 25, 1987 [GB] United Kingdom ..... 8727634

[51] Int. Cl.[5] ..... B66B 5/16

[52] U.S. Cl. ..... 187/89; 187/108

[58] Field of Search ..... 187/73, 80, 89, 90, 187/38, 39, 106, 105, 108, 109, 131

[56] References Cited

U.S. PATENT DOCUMENTS

| | | | |
|---|---|---|---|
| 1,132,770 | 3/1915 | Gale, Sr. | 187/109 |
| 1,924,320 | 8/1933 | James | 187/109 |
| 1,924,321 | 8/1933 | James | 187/108 |
| 1,977,452 | 10/1934 | Neuschotz | 187/89 |
| 2,716,467 | 8/1955 | Callaway | 187/90 |
| 2,792,080 | 5/1957 | Dunlop | 187/108 |

FOREIGN PATENT DOCUMENTS

| | | | |
|---|---|---|---|
| 0146361 | 11/1979 | Japan | 187/73 |
| 1286490 | 1/1987 | Japan | 187/89 |

*Primary Examiner*—Michael S. Huppert
*Assistant Examiner*—Kenneth Noland
*Attorney, Agent, or Firm*—Wolf, Greenfield & Sacks

[57] ABSTRACT

A lift is provided with a detector for sensing when the brakes are engaged and the motor is disengaged. A tachometer detects movement of the lift, the lift slipping despite the engagement of the brakes, and causes the sensing means to activate a wire clamp, which clamps an endless wire. The stopping of the endless wire causes clamps within safety gears on the lift to grip guide rails alongside the lift and so stop the descent of the lift.

25 Claims, 2 Drawing Sheets

LIFT

DESCRIPTION OF INVENTION

The present invention relates to a lift and more particularly to a lift comprising means for preventing lift slippage during overloading.

A major problem of lift design is the provision of safety measures to prevent accidents caused by overloading of the lift. Many lifts are suspended from a cable, for instance wire rope or a set of wire ropes, wrapped around a winch, the other end of the cable being attached to a counterweight to balance the weight of the lift.

However, when the lift is overloaded, the counterweight has insufficient mass to properly counter-balance the lift. As a result the lift may speed excessively when descending, so producing a strain on the cable and the brakes, when used, which in turn places the lift in danger of speeding to the bottom of the lift shaft, either because the cable has broken or because the brakes have been unable to halt the momentum of the descending lift. This, of course, presents a danger to the lift cargo, which may include passengers.

Figure 2:
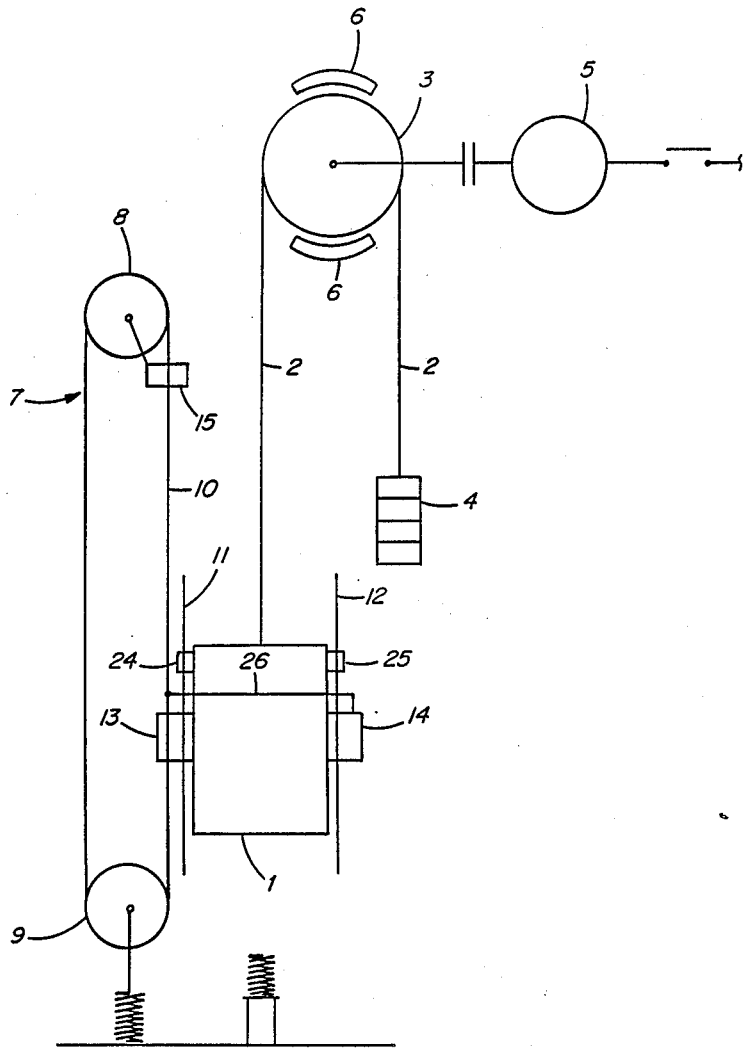
FIG. 2 (PRIOR ART)

FIG. 2 shows a device presently used for avoiding accidents such as these, caused by excessive build up of lift speed due to overloading. A lift 1 is suspended by a cable 2 and the cable 2 is wrapped around a winch or driving sheave 3. The end of the cable 2 opposite to the end attached to the lift 1 hangs down from the driving sheave 3 and is attached to a counterweight 4 which counterbalances the weight the weight of the lift 1. The driving sheave 3 is used to winch the lift 1 up and down and is powered by means of a motor 5 sometimes by means of a gearbox. The rotation of the running sleeve 3 may be stopped, when the lift is required to halt, by de-energization of the motor 5 and activation of a brake 6.

The lift 1 is further provided with an overspeed prevention device 7. This overspeed protection device 7 comprises two spaced apart pulleys 8, 9 positioned at the side of the lift shaft, one pulley 8, 9 at either end of the lift shaft. Around the two pulleys 8, 9 is looped and endless wire 10 so that the endless wire 10 extends down the side of the lift shaft parallel with a guide rail 11. This guide rail 11 is one of a pair of guide rails 11, 12 which extend down opposite sides of the lift shaft and serve to guide the lift 1 up and down the shaft.

The lift 1 guided along the guide rails 11, 12 by means of two guide blocks 24, 25 such as guide shoes. Each guide block 24, 25 extends from a side of the lift 1 adjacent a guide rail 11, 12 and extends round the respective guide rail 11, 12 so that each guide block 24, 25 is slidably movable along the respective guide rail 11, 12.

The safety gears 13, 14 are also situated on the sides of the lift 1, each adjacent a guide rail 11, 12. The safety gear 13, adjacent the endless wire 10, extends around the endless wire 10 so as to pull the endless wire 10 with the safety gear 13, as the lift 1 moves, by friction. A movement detector is contained within the safety gear 13 adjacent the endless wire 10. The movement detector is arranged to detect relative movement between the endless wire 10 and the safety gear 13. When such movement is detected by the movement exceeds the safety level, the speed governor 8 will actuate the wire clamp 15. The wire clamp 15 when actuated, will hold the endless wire 10 stationary. Because the lift 1 will continue to descend, the safety gear 13, associated with the endless wire 10, will move relative to the stationary endless wire 10. This relative movement will be detected by the movement detector contained within the safety gear 13 and the movement detector will, in turn, actuate the mechanical linkage 26 and the clamps contained within both safety gears 13, 14. These clamps will grip the guide rails 11, 12 so halting the movement of the lift 1.

Thus when an overloaded lift descends at a speed which is dangerous, the device shown in FIG. 2 will halt the descent of the lift.

Many lifts of the type shown in FIG. 2 also possess a further safety device not shown in FIG. 2. This second overload device is operable when the lift has halted at a floor. The second overload device comprises a device for detecting the mass of the lift car and contents. When the mass of the lift car and contents exceeds the safe limit the overload device will operate to prevent the operation of the lift motor 5 and/or to maintain the activation of the brakes 6 of the lift.

However a further problem has now become clear when such a lift becomes overloaded, especially when the lift is relatively old. In such lifts the brakes may be worn and their grip on the driving sheave may not be as strong as it should be. If the lift becomes overloaded at rest in such circumstances, although the brakes 6 of the lift may be activated by the second overload device, the lift may still start to slip downwards, the driving sheave 3 rotating due to the faulty grip of the brakes 6. The additional danger of such an event is that, although the brakes are unable to prevent rotation of the driving sheave 3, the grip of the brakes 6 on the driving sheave 3 is sufficient to ensure that the speed of the descending lift 1 never rises sufficiently to allow the speed governor 8 to active the overload device incorporating the clamps within the safety gears 13, 14. Thus an overload of a lift of the prior art may lead to the lift slipping, at an appreciable but not excessive speed, to the floor of the lift shaft, which event is very dangerous.

It is an object of the present invention to overcome, or at least mitigate, the above-mentioned disadvantages of the prior art.

According to the present invention there is provided a lift comprising a first brake, actuable to prevent movement of the lift, movement detecting means for detecting movement of the lift when the first brake is actuated, a second brake, actuable to prevent movement of the lift, and means for actuating the second brake when movement of the lift is detected by the movement detecting means, so that the second brake stops slippage of the lift when the first brake is actuated.

It is preferable that the lift is driven by a motor, usually an electric motor, which motor drives a driving sheave. The first brake may act on the driving sheave.

In one embodiment of the present invention the movement detecting means, which may be a tachometer, is associated with the driving sheave to detect movement thereof.

Preferably the means for actuating the second brake is a sensing and/or control electrical circuit. More preferably this circuit may be supplied by both mains power and a standby battery. Most preferably the circuit further comprises means for detecting actuation of the first brake and/or means for detecting actuation of the motor.

The lift of the present invention may further comprise a speed governor, a guide rail adjacent the lift cage, and clamping means, positioned on the lift cage, actuable in response to the speed governor, the clamping means being actuable to grip the guide rail so as to prevent movement of the lift relative to the guide rail. More preferably the second brake and the clamping means are the same.

Figure 1:
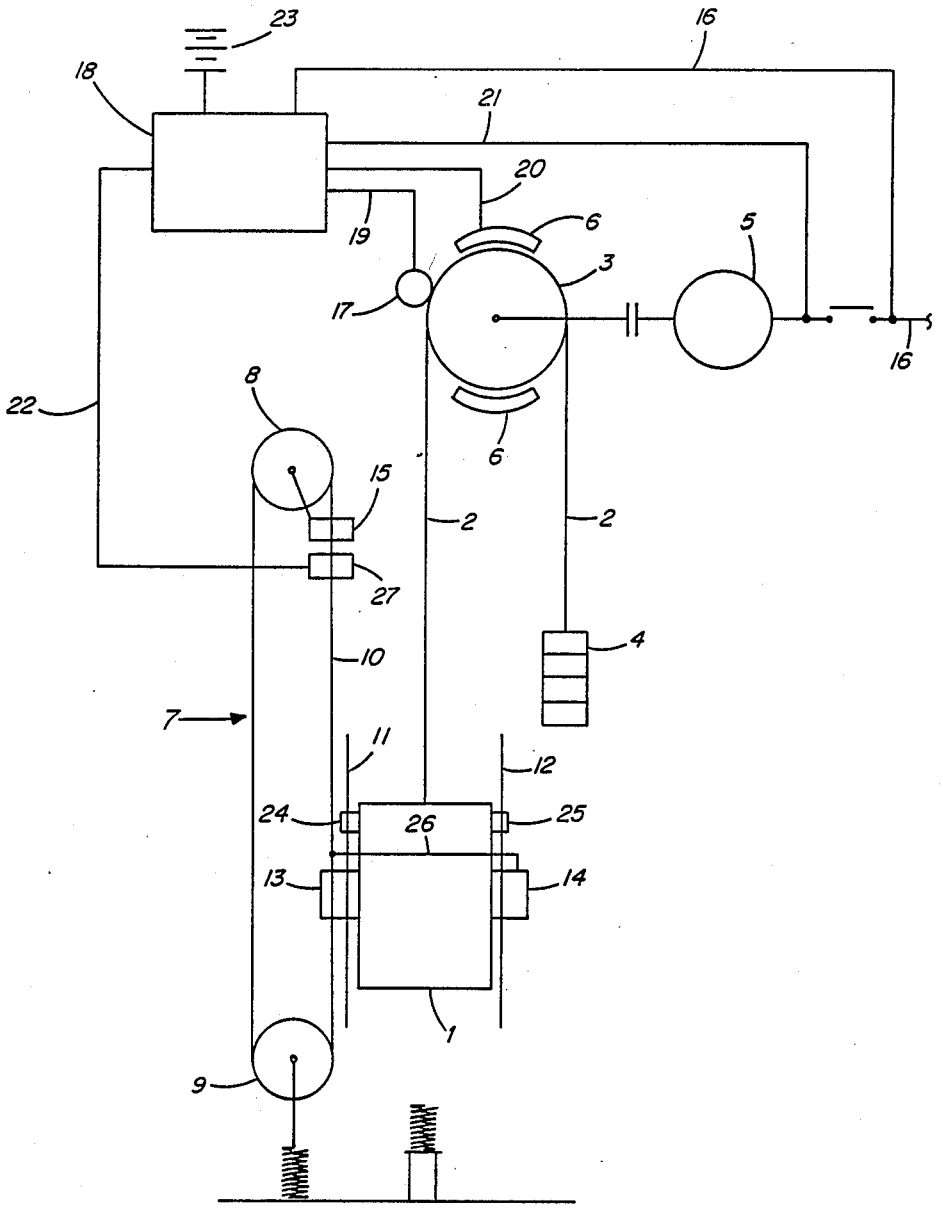

For better understanding of the present invention, and to show how the same may be put into effect, reference will now be made, by way of example, to the accompanying drawings, in which:

FIG. 1 shows a schematic view of the lift according to one embodiment of the present invention, and FIG. 2 shows a schematic view of a lift according to the prior art.

FIG. 2 has been described above, and in FIG. 1 the same reference numerals have been used for the same parts of the lift.

The lift of FIG. 1 is powered by an electric motor 5, powered by a mains power supply 16. The lift possesses an overload system comprising a tachometer 17 and a sensor and control circuit 18. The tachometer 17 is associated with the driving sheave 3 so as to detect movement of the driving sheave 3. When such movement is detected, a signal is transmitted, by the tachometer 17, via a line 19, to the sensor and control circuit 18. The sensor and control circuit 18 also receives information from a first detection means 20 as to whether the brakes 6 are closed or open, and from a second detection means 21 as to whether the motor 5 is activated. The sensor and control circuit 18 is connected to a second wire clamp 27, around the endless wire 10, by a control line 22, so as to actuate the wire clamp 27.

Thus when the sensor and control circuit 18 receives the information that the motor 5 is inactivated, that the brakes 6 is closed and that the driving sheave 3 is moving, the conditions in which the lift 1 is slipping due to overloading, the sensor and control circuit 18 actuates the second wire clamp 27 by way of the control line 22 so as to clamp the endless wire 10. The movement of the safety gear 13 adjacent the endless wire 10, with respect to the now-stationary endless wire 10 is detected by the movement detector within the safety gear 13. The movement detected by the movement detector actuates the clamps within the respective safety gears 13, 14 causing the clamps to grip the guide rails 11, 12 and so arest the downward movement of the lift 1. Thus the present invention provides a feedback system to arrest the slippage of an overloaded lift, or, indeed, a lift that is not overloaded but has faulty brakes.

An alternative arrangement would be to combine the first wire clamp 15 in the speed governor 8 with the second wire clamp 27 into one integral mechanism which can be actuated either by the speed governor 8 or the sensor and control circuit 18.

For extra safety the embodiment of the present invention shown in FIG. 1 has the sensor and control circuit 18 powered by the mains power supply 16, but having a back-up battery power supply 23 for use should the mains power supply 16 fail.

I claim:

1. A lift apparatus comprising a lift, means for raising and lowering the lift, a first brake actuable to prevent movement of the lift, means for detecting actuation of said means for raising and lowering, movement detecting means for detecting a movement of the means for raising and lowering when the first brake is actuated, guide means for directing the lift, a second brake actuable to prevent movement of the lift by acting on the guide means, and control means responsive to at least said means for detecting actuation of said means for raising and lowering and said movement detecting means for actuating the second brake when movement of the lift is detected by the movement detecting means, so that the second brake stops slippage of the lift when the first brake is actuated, the means for raising and lowering the lift is stopped, and the lift is moving.

2. A lift apparatus according to claim 1, further comprising a motor for driving the lift.

3. A lift apparatus according to claim 2, wherein the motor is an electronic motor.

4. A lift apparatus according to claim 2 or 3, wherein said means for raising and lowering the lift further comprises a driving sheave drivable by the motor.

5. A lift apparatus according to claim 4 wherein the movement detecting means is associated with the driving sheave to detect movement thereof.

6. A lift apparatus according to claim 2, wherein the means for actuating the second brake comprises electrical circuit means.

7. A lift apparatus according to claim 6, wherein the electrical circuit means may be supplied by both mains power and a battery.

8. A lift apparatus according to claim 7, wherein the circuit means further comprises means for detecting actuation of the motor.

9. A lift apparatus according to claim 8, wherein the circuit means further comprises means for detecting actuation of the first brake.

10. A lift apparatus according to claim 1, further comprising a speed governor, wherein the lift further comprises a cage, the guide means further comprises a guide rail adjacent the cage of the lift, and clamping means positioned on the cage of the lift, actuable in response to the speed governor, the clamping means being actuable to grip the guide rail so as to prevent movement of the lift relative to the guide rail.

11. A lift apparatus according to claim 10, wherein the second brake and the clamping means are the same.

12. A lift apparatus according to claim 10 or 11 wherein the clamping means are contained within at least one safety gear positioned on the cage of the lift.

13. A lift apparatus comprising a lift, means for raising and lowering the lift, a first brake actuable to prevent movement of the lift, movement detecting means comprising a tachometer for detecting movement of the means for raising and lowering when the first brake is actuated, guide means for directing the lift, a second brake, actuable to prevent movement of the lift by acting on the guide means, and means for actuating the second brake when movement of the lift is detected by the movement detecting means, so that the second brake stops slippage of the lift when the first brake is actuated.

14. In an apparatus for controlling movement of a lift having a drive means, a first brake means to prevent movement of the lift and guide means for directing the lift, the improvement comprising means for detecting movement of the lift when the first brake means is actuated, means for detecting actuation of said drive means, a second brake means to prevent movement of the lift by acting on the guide means, and control means responsive to at least said means for detecting movement of the lift and said means for detecting actuation of said drive means for actuating the second brake means when movement of the lift is detected by the movement detecting means and the first brake means is actuated and the drive means is stopped, whereby the second brake means stops any slippage of the lift that may occur when the first brake means is operated.

15. An apparatus as set forth in claim 14 including means for driving of the lift, said means for detecting movement of the lift including means for detecting movement of the drive means.

16. An apparatus as set forth in claim 14 wherein said second brake means comprises clamping means.

17. In an apparatus for controlling movement of a lift having means for driving the lift, a first brake means to prevent movement of the lift and guide means for directing the lift, the improvement comprising means for detecting movement of the lift including means for detecting movement of the drive means when the first brake means is actuated, a second brake means to prevent movement of the lift by acting on the guide means, and means for actuating the second brake means when movement of the lift is detected by the movement detecting means, said means for actuating comprising control circuit means including means for detecting actuation of a drive motor and means for detecting actuation of the first brake means.

18. An apparatus for controlling movement of a lift and comprising, means for driving the lift, brake means associated with said means for driving, means for detecting actuation of said driving means, means for detecting movement of said lift, guide means for directing movement of said lift, means for detecting actuation of said brake means, means for inhibiting fall of said lift which act on said guide means, and control means responsive to said means for detecting actuation of said drive means, said means for detecting movement of said lift and said means for detecting actuation of said brake means, for operating said means for inhibiting when said drive means is stopped, and said brake means is actuated, and said lift is moving.

19. An apparatus as set forth in claim 18 wherein said means for driving includes a drive motor, said means for detecting movement of the lift includes a tachometer, said means for detecting actuation of the brake means includes means for determining opening or closing of the brake means, and said means for inhibiting fall of said lift includes a second brake means.

20. An apparatus as set forth in claim 19 wherein said control means includes circuit means.

21. An apparatus for controlling movement of a lift and comprising:

means for driving the lift comprising a driving sheave;

means for detecting actuation of said driving means;

brake associated with said driving sheave;

means for detecting actuation of said brake means;

means for inhibiting fall of said lift;

means for sensing slippage of the lift even though said brake means is actuated;

said means for sensing comprising means for detecting rotation of the driving sheave; and control means responsive to said means for detecting actuation of said driving means, said means for detecting actuation of said brake means, and said means for sensing, for activating said means for inhibiting when said drive is stopped, and said brake means is actuated, and said driving sheave is rotating.

22. An apparatus as set forth in claim 21 wherein said means for driving includes a drive motor, said means for detecting movement of the lift includes, a tachometer, said means for detecting actuation of the brake means includes means for determining opening or closing of the brake means, and said means for inhibiting fall of said lift includes a second brake means.

23. An apparatus as set forth in claim 22 wherein said control means includes circuit means.

24. A lift apparatus comprising a lift, means for raising and lowering the lift including sheave means and cable, a first brake means associated with said means for raising and lowering and actuable to prevent movement of the lift, movement detecting means for detecting movement of the lift even though the first brake means is actuated, said movement detecting means comprising means for detecting movement of only the sheave means without relative movement between the sheave means and the cable means, a second brake means actuable to prevent movement of the lift, and means for actuating the second brake means when movement of the lift is detected by the movement detecting means, so that the second brake means stops slippage of the lift when the first brake means is actuated.

25. A lift apparatus according to claim 24 wherein said second brake means operates independently of said cable means in directly stopping the lift.

* * * * *